US006357863B1

(12) United States Patent
Anderson et al.

(10) Patent No.: US 6,357,863 B1
(45) Date of Patent: Mar. 19, 2002

(54) LINEAR SUBSTRATE HEATER FOR INK JET PRINT HEAD CHIP

(75) Inventors: Frank Edward Anderson, Sadieville; Shirish Padmakar Mulay, Lexington; George Keith Parish, Winchester, all of KY (US)

(73) Assignee: Lexmark International Inc., Lexington, KY (US)

( * ) Notice: Subject to any disclaimer, the term of this patent is extended or adjusted under 35 U.S.C. 154(b) by 0 days.

(21) Appl. No.: 09/453,104

(22) Filed: Dec. 2, 1999

(51) Int. Cl.[7] ..... B41J 2/05; B41J 2/01
(52) U.S. Cl. ..... 347/58; 347/54
(58) Field of Search ..... 347/58, 20, 23, 347/26, 40, 48, 50, 54, 56, 57, 59, 60, 61, 67, 17, 19

(56) References Cited

U.S. PATENT DOCUMENTS

| | | | | |
|---|---|---|---|---|
| 4,125,845 A | | 11/1978 | Stevenson, Jr. | |
| 4,623,903 A | | 11/1986 | Hashimoto | |
| 4,704,620 A | | 11/1987 | Ichihashi et al. | |
| 4,719,472 A | * | 1/1988 | Arakawa | 347/67 |
| 4,899,180 A | | 2/1990 | Elhatem et al. | |
| 4,980,702 A | | 12/1990 | Kneezel et al. | |
| 5,081,473 A | | 1/1992 | Hawkins et al. | |
| 5,175,565 A | * | 12/1992 | Ishinaga et al. | |
| 5,208,611 A | | 5/1993 | Kappel et al. | |
| 5,307,093 A | | 4/1994 | Susuki et al. | |
| 5,402,160 A | | 3/1995 | Kadowaki et al. | |
| 5,512,924 A | | 4/1996 | Takada et al. | |
| 5,622,897 A | | 4/1997 | Hayes | |
| 5,689,292 A | | 11/1997 | Suzuki et al. | |
| 5,734,392 A | * | 3/1998 | Cornell | 347/17 |
| 5,745,132 A | | 4/1998 | Hirabayashi et al. | |
| 5,760,797 A | | 6/1998 | Koizumi et al. | |
| 5,880,753 A | * | 3/1999 | Ikeda et al. | 347/17 |
| 6,190,492 B1 | * | 2/2001 | Byrne et al. | 156/273.7 |

* cited by examiner

*Primary Examiner*—N. Le
*Assistant Examiner*—Matthew T. Welker
(74) *Attorney, Agent, or Firm*—D. Brent Lambert; Michael T. Senderson; Mark P. Crockett

(57) ABSTRACT

An ink jet print head includes a nozzle plate having a substantially linear array of ink jet nozzles through which ink droplets are ejected toward a print medium. An integrated circuit chip, which is disposed adjacent the nozzle plate on the print head, includes a semiconductor substrate, a source voltage conductor connected to a source voltage, and a ground return conductor. A substantially linear array of ink heating resistors are disposed on the substrate substantially parallel to the length of the chip, each associated with a corresponding one of the ink jet nozzles. The chip also includes a plurality of substrate heater resistors disposed on the substrate in a substantially linear arrangement and aligned substantially parallel with the nozzles. The substrate heater resistors are electrically connected in parallel, with one node of each being connected to the source voltage conductor and another node of each being connected to the ground return conductor. Preferably, the substrate heater resistors include first substrate heater resistors disposed near a lengthwise center of the chip and second substrate heater resistors that are distally disposed relative to the lengthwise center of the chip. The first and second substrate heater resistors have different first and second electrical resistance values, respectively, that are determined by thermal dissipation patterns of the chip. The difference between the first and second electrical resistance values cause the first and second substrate heater resistors to generate different amounts of heat when supplied with the source voltage. The different amounts of heat generated by the first and second substrate heater resistors and the relative positions of the first and second substrate heater resistors compensate for differing thermal dissipation patterns across the chip.

12 Claims, 3 Drawing Sheets

LINEAR SUBSTRATE HEATER FOR INK JET PRINT HEAD CHIP

FIELD OF THE INVENTION

The present invention is generally directed to temperature control of ink jet print heads. The invention is more particularly directed to an arrangement of heater resistors on an ink jet print head chip for providing even distribution of heat across the chip.

BACKGROUND OF THE INVENTION

An ink jet printer forms images consisting of patterns of ink dots. The ink dots are formed by droplets of ink that are ejected from an array of ink jet nozzles onto a print medium. The quality of the image formed by the ink jet printer is dependent, among other things, upon careful control of the volume and mass of the ink droplets. Ideally, the volume and mass of each droplet ejected from each nozzle in the array should be the same. Further. for best image quality, the volume and mass of ink droplets ejected from a single nozzle in the array should not vary over time.

One of the factors that affects ink volume is temperature. If there is significant variation in temperature from one area of the nozzle array to another, there is typically a corresponding variation in droplet volume. Thus, it is desirable to carefully control the temperature of an ink jet print head to keep the temperature fairly constant across the length of the nozzle array.

As the state of the art advances, ink jet printers are incorporating longer nozzle arrays to produce wider printed swaths. The latest print head designs are also incorporating metal heat sinks to transfer excessive heat away from the circuitry on the print head chip. Print heads having the longer nozzle arrays and/or metal heat sinks can develop significant temperature variations across the length of the nozzle array. As discussed above, such temperature variations across the array can have detrimental effect on the printed image.

Therefore, an apparatus is needed for reducing temperature variations across an ink jet print head.

SUMMARY OF THE INVENTION

The loregoing and other needs are met by an ink jet print head that includes a nozzle plate having a substantially linear array of ink jet nozzles through which ink droplets are ejected toward a print medium. An integrated circuit chip is disposed adjacent the nozzle plate on the print head. The chip includes a semiconductor substrate, a source voltage conductor disposed on the substrate and connected to a source voltage, and a ground return conductor disposed on the substrate. A substantially linear array of ink heating resistors are disposed on the substrate substantially parallel to the length of the chip. Each of the ink heating resistors is associated with a corresponding one of the ink jet nozzles. The chip also includes a plurality of substrate heater resistors disposed on the semiconductor substrate in a substantially linear arrangement and aligned substantially parallel with the ink jet nozzles. The substrate heater resistors are electrically connected in parallel with one node of each of the substrate heater resistors being connected to the source voltage conductor and another node of each of the substrate heater resistors being connected to the ground return conductor.

In preferred embodiments of the inventions the substrate heater resistors include first substrate heater resistors that are disposed near a lengthwise center of the chip and second substrate heater resistors that are distally disposed relative to the lengthwise center of the chip. The first and second substrate heater resistors have first and second electrical resistance values. respectively that are determined by thermal dissipation patterns of the chip. Preferably the second electrical resistance values are different from the first electrical resistance values. The difference between the first and second electrical resistance values cause the first and second substrate heater resistors to generate different amounts of heat when supplied with the source voltage. The different amounts of heat generated by the first and second substrate heater resistors and the relative positions of the first and second substrate heater resistors compensate for differing thermal dissipation patterns across the chip.

Thus, the present invention significantly reduces temperature variations across the print head chip and thereby reduces differences in ink temperature along the array of ink jet nozzles. By compensating for differences in ink temperature along the array of nozzles. the invention essentially eliminates temperature-induced variations in the sizes of ejected ink droplets.

BRIEF DESCRIPTION OF THE DRAWINGS

Further advantages of the invention will become apparent by reference to the detailed description of preferred embodiments when considered in conjunction with the drawings, which are not to scale, wherein like reference characters designate like or similar elements throughout the several drawings as follows.

DETAILED DESCRIPTION OF THE INVENTION

Figure 1:
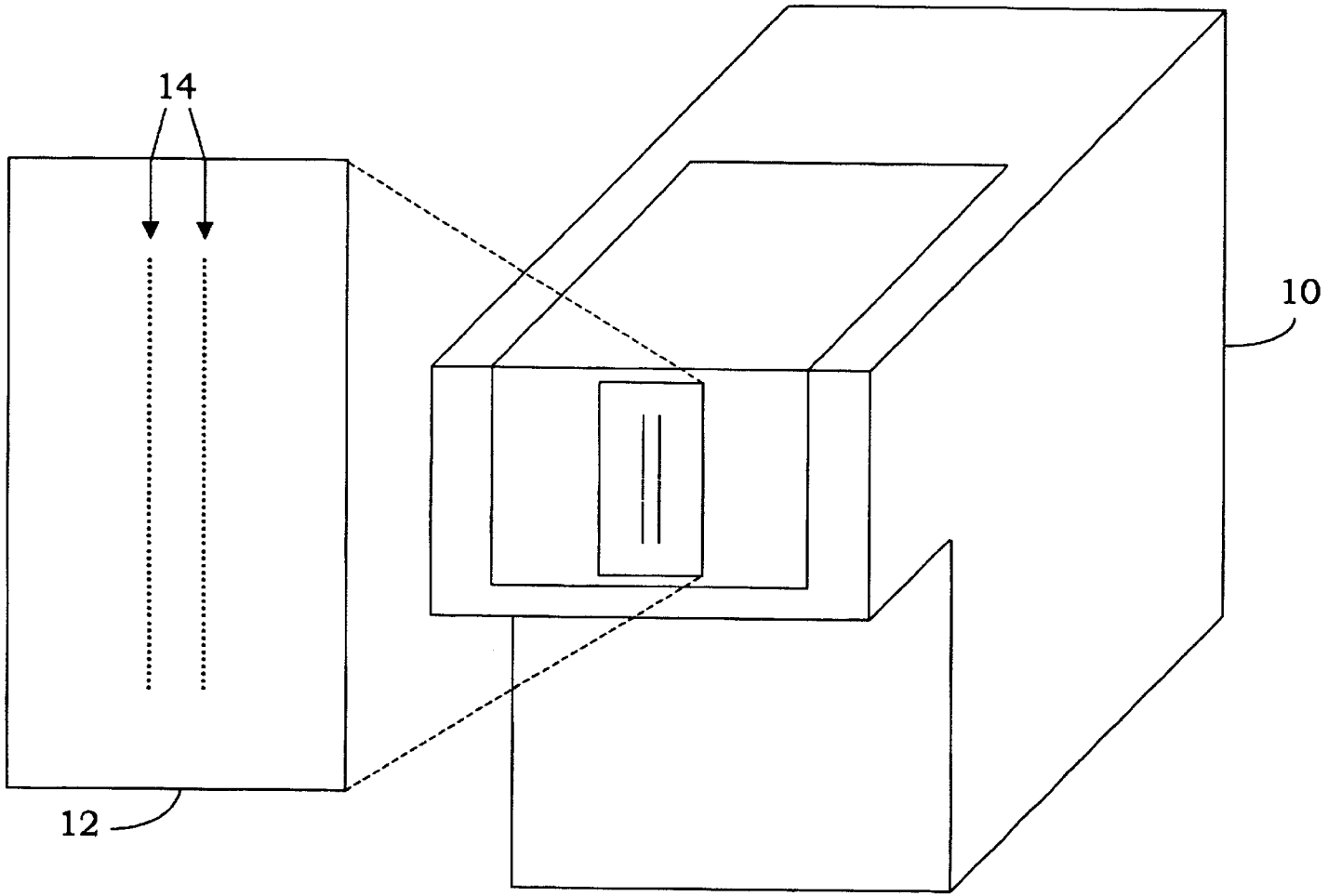
FIG. 1 depicts an ink jet print head and nozzle plate according to a preferred embodiment of the invention.

Shown in FIG. 1 is an ink jet print head 10 such as may be used in an ink jet printing apparatus. On the print head 10 is a nozzle plate 12 containing a substantially linear array of ink jet nozzles 14. In a preferred embodiment of the invention, the nozzle array 14 includes two substantially parallel columns of nozzles. However, the invention described herein is to also applicable to print heads having one, three, or more columns of nozzles. The thermal ink jet print head 10 forms images on a print medium by selectively ejecting droplets of ink from the nozzles in the nozzle array 14 as the print head 10 translates across the print medium in a direction generally perpendicular to the direction of alignment of the nozzle array 14.

Figure 2:
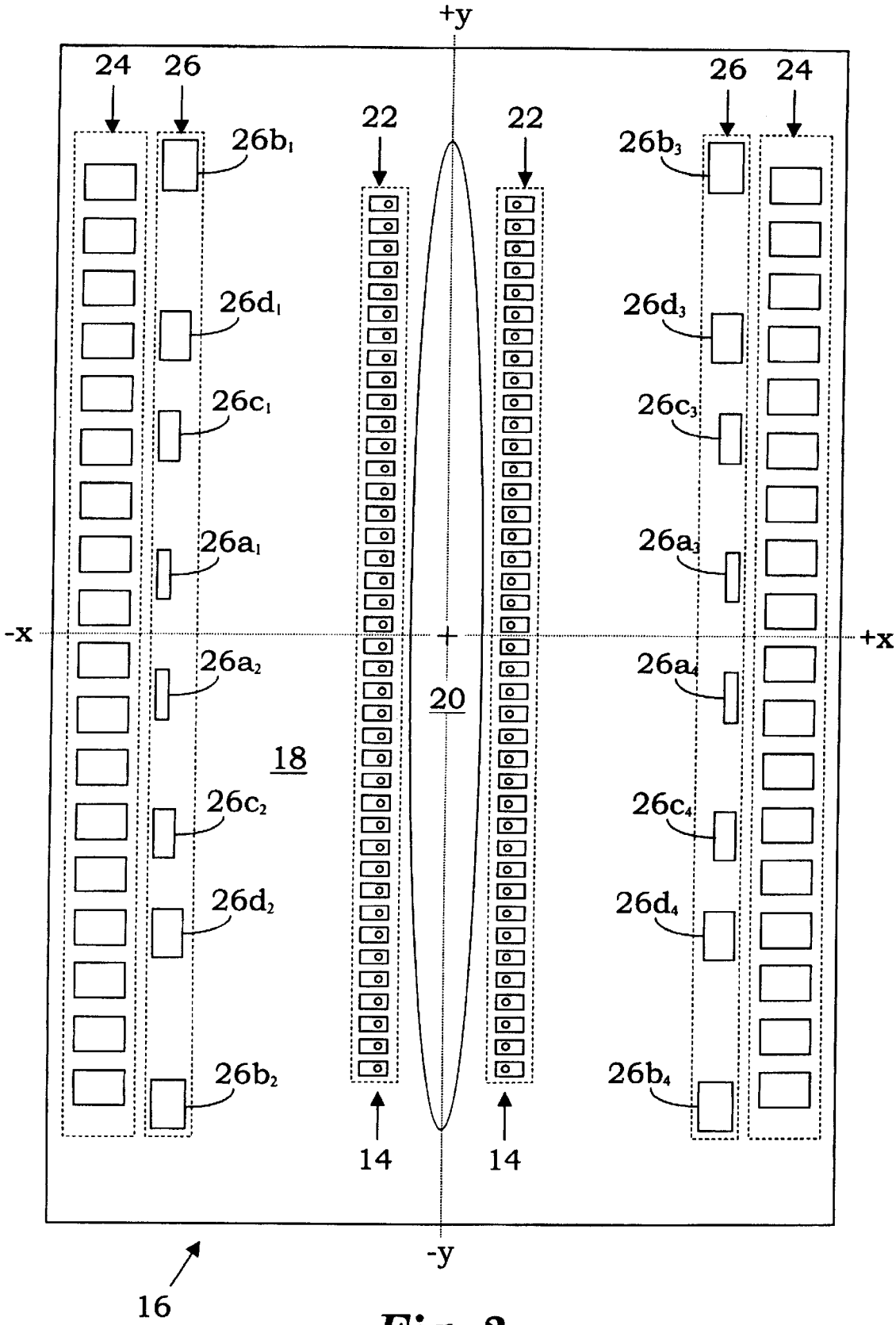
FIG. 2 depicts an integrated circuit chip in an ink jet print head according to a preferred embodiment of the invention.

Beneath and adjacent the nozzle plate 12 in the print head 10 is an integrated circuit (IC) chip 16 as depicted in FIG. 2. The chip 16 includes a semiconductor substrate 18 upon which several active and passive components are formed. Generally in the center of the chip 16 is an ink via 20. On either side of the ink via 20 is a column of ink heating resistors 22 formed on the substrate 18. Preferably, there is an ink heating resistor 22 corresponding to each nozzle in the nozzle array 14. Each resistor 22 generates heat when a driving voltage is selectively applied across it. Heat generated by the resistor 22 transfers into adjacent ink causing, formation of an ink bubble. The ink bubble forces a droplet of ink through the corresponding nozzle.

FIG. 2 also depicts the relative position of the nozzle array 14 in relation to components of the IC chip 16. As described previously, the nozzle array 14 exists in the nozzle plate 12 which is above the IC chip 16. Thus, the position of the array 14 is depicted in FIG. 2 for positional reference purposes only. To provide a positional reference for discussion of components on the chip 16, FIG. 2 includes a Y-axis parallel to the length and an X-axis parallel to the width of the chip 16. The origin of each axis is at the chip center.

Adjacent the outer edges of the chip 16 are input/output (I/O) contact pads, indicated generally by reference numeral 24 in FIG. 2. These I/O pads 24 are areas of electrically conductive material that provide connection points between components on the chip 16 and off-chip circuitry in the print head 10.

As discussed above, undesired variations in ink droplet size and mass degrade the quality of an image printed by an ink jet printer. Since ink temperature affects ink droplet size and mass, one of the design goals for ink jet print heads is maintaining a substantially constant ink temperature across the print head chip 16. The present invention maintains substantially constant ink temperature across the print head chip 16 by the use of substrate heater resistors as indicated generally by reference numeral 26 in FIG. 2. As described in more detail hereinafter the substrate heater resistors 26 generate heat to warm the substrate 18 when a voltage is applied across their nodes. Preferably the substrate heater resistors 26 consist of rectangular sections of Tantalum Aluminum deposited on the substrate 18 at the same layer level as the ink heating resistors 22.

In the preferred embodiment of the invention, the substrate heater resistors 26 are arranged parallel to the array of nozzles 14 and the ink heating resistors 22 in a substantially linear fashion. Preferably the substrate heater resistors 26 are located on the chip 16 between the ink heating resistors 22 and the I/O pads 24. In the preferred embodiment, a resistance value for each substrate heater 26 is determined by thermal dissipation patterns of the chip 16 and by the location of the substrate heater 26 relative to the ink heating resistors 22 and the nozzle array 14. By adjusting the individual resistance values of each of the substrate heater resistors 26, the amount of heat generated by each substrate heater 26 may be precisely controlled. In this way, the invention compensates for thermal loss variations across the chip 16.

In the preferred embodiment, substrate heater resistors 26 located near the length-wise center of the chip 16 (those nearest the X-axis) are designed to generate less heat than those toward the outer edges of the chip 16. Plus, as shown in FIG. 2, centrally-located substrate heater resistors 26$a_1$–26$a_4$ of the preferred embodiment, also referred to herein as first substrate heater resistors, have higher resistance values than do the substrate heater resistors 26 that are located farther out from the center of the chip 16. Correspondingly, the most distally-located substrate heater resistors 26$b_1$–26$b_4$, also referred to herein as second substrate heater resistors, have lower resistance values (thus generating more heat) than do the first substrate heater resistors 26$a_1$–26$a_4$.

Located between the first substrate heater resistors 26$a_1$–26$a_4$ and second substrate heater resistors 26$b_1$–26$b_4$, the preferred embodiment of the invention includes third substrate heater resistors 26$c_1$–26$c_4$ having resistance values preferably intermediate to the resistance values of the first and second substrate heater resistors 26$a_1$–26$a_4$ and 26$b_1$–26$b_4$. Located between the second substrate hearer resistor 26$b_1$–26$b_4$ and the third substrate heater resistors 26$c_1$–26$c_4$, the preferred embodiment of the invention further includes fourth substrate heater resistors 26$d_1$–26$d_4$ having resistance values preferably intermediate to the resistance values of the second and third substrate heater resistors 26$b_1$–26$b_4$ and 26$c^1$–26$c_4$.

Table I presents substrate heater locations, resistance values, and dimensions according to an especially preferred embodiment of the invention.

TABLE I

| Reference numeral: | Resistance (ohms): | Length (Y) (microns) | Width (X) (microns) | X Location of center (microns): | Y Location of center (microns): |
|---|---|---|---|---|---|
| $26b_1$ | 140 | 412.000 | 65.875 | −1725.250 | 6916.500 |
| $26d_1$ | 180 | 412.000 | 51.250 | −1715.125 | 4715.375 |
| $26c_1$ | 315 | 412.000 | 29.250 | −1729.875 | 2754.500 |
| $26a_1$ | 325 | 412.000 | 28.375 | −1730.875 | 964.500 |
| $26a_2$ | 325 | 412.000 | 28.375 | −1730.875 | −964.500 |
| $26c_2$ | 259 | 412.000 | 35.625 | −1727.125 | −2747.125 |
| $26d_2$ | 171 | 412.000 | 54.000 | −1729.250 | −4718.125 |
| $26b_2$ | 126 | 412.000 | 73.250 | −1706.875 | −7252.500 |
| $26b_3$ | 140 | 412.000 | 65.875 | 1725.250 | 6916.500 |
| $26d_3$ | 180 | 412.000 | 51.250 | 1715.125 | 4715.375 |
| $26c_3$ | 315 | 412.000 | 29.250 | 1729.875 | 2754.500 |
| $26a_3$ | 325 | 412.000 | 28.375 | 1730.875 | 964.500 |
| $26a_4$ | 325 | 412.000 | 28.375 | 1730.875 | −964.500 |
| $26c_4$ | 259 | 412.000 | 35.625 | 1727.125 | −2747.125 |
| $26d_4$ | 171 | 412.000 | 54.000 | 1729.250 | 4718.125 |
| $26b_4$ | 126 | 412.000 | 73.250 | 1706.875 | −7252.500 |

Figure 3:
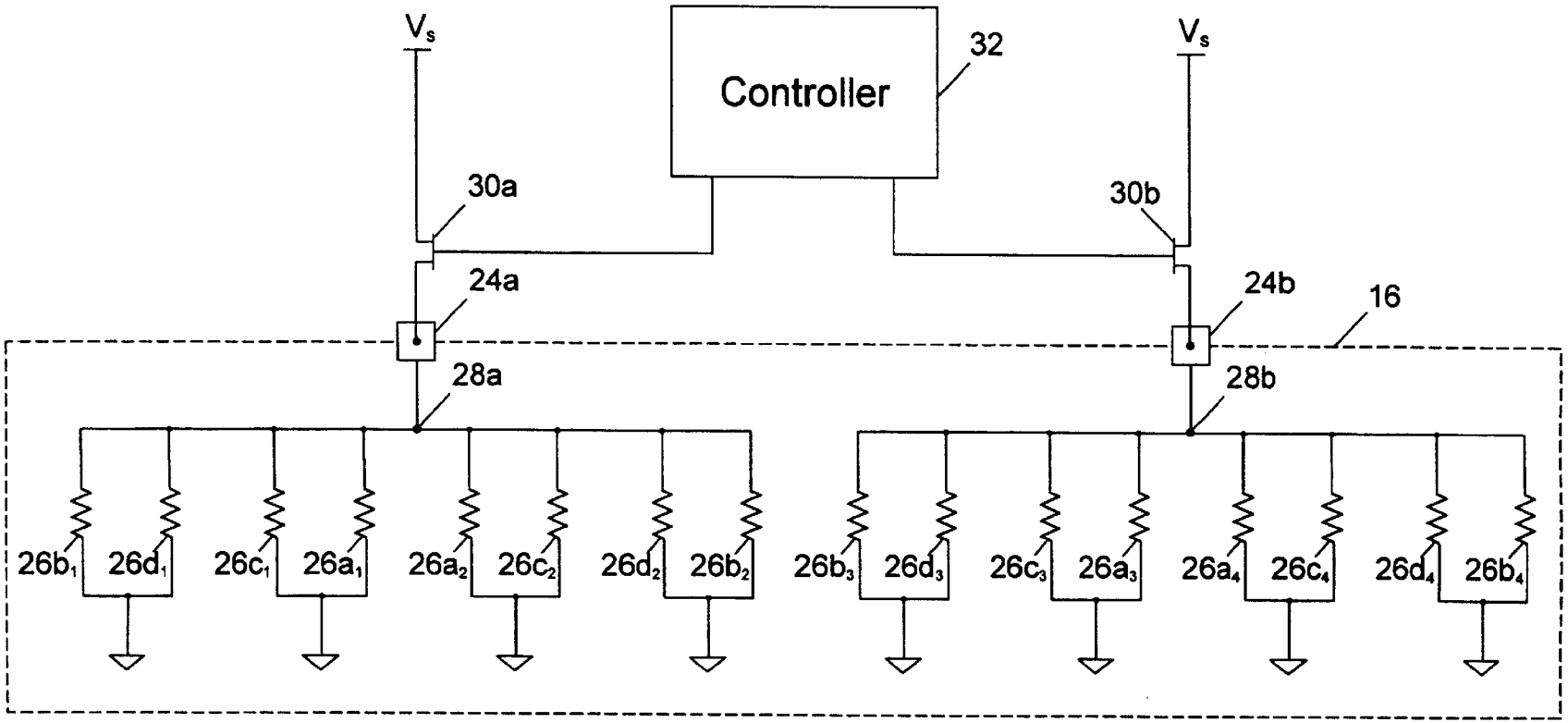
FIG. 3 is a schematic diagram of a system of substrate heater resistors according to a preferred embodiment of the invention.

Shown in FIG. 3 is the preferred embodiment for providing electrical power to the substrate heater resistors 26. Preferably, the eight substrate heater resistors 26$a_1$, 26$b_1$, 26$c_1$, 26$d_1$, 26$a_2$, 26$b_2$, 26$c_2$, and 26$d_2$ are electrically connected in parallel, with one side of each connected to a common node 28*a*. Similarly, the other eight substrate heater resistors 26$a_3$, 26$b_3$, 26$c_3$, 26$d_3$, 26$a_4$, 26$b_4$, 26$c_4$, and 26$d_4$, are also connected in parallel, with one side of each connected to a common node 28*b*. The other sides of the substrate heater resistors 26 are connected to ground return lines on the chip 16. Preferably, these ground return lines are the same ground returns provided for the ink-heating resistors 22. In this manner, implementation of the invention does not add a large number of extra traces to an already crowded print head chip 16. With the parallel arrangement, there is no need to route a continuous trace from one substrate heater 26 to another around the periphery of the chip 16 such as would be required with a series arrangement.

As shown in FIG. 3, the nodes 28*a* and 28*b* are connected to I/O pads 24*a* and 24*b* at the edge of the chip 16. A pair of switching devices, such as JFETs 30*a* and 30*b*, are connected between the I/O pads 24*a* and 24*b* and a voltage source $V_s$. Voltage levels on the gates of the JFETs 30*a* and 30*b* are controlled by a controller 32 to turn the JFETs 30*a* and 30*b* on or off. When the JFET 30*a* is on, the eight substrate heater resistors 26$a_1$, 26$b_1$, 26$c_1$, 26$d_1$, 26$a_2$, 26$b_2$, 26$c_2$, and 26$d_2$, are on simultaneously. Similarly, when the JFET 30*b* is on, the eight substrate heater resistors 26$a_3$, 26$b_3$, 26$c_3$, 26$d_3$, 26$a_4$, 26$b_4$, 26$c_4$, and 26$d_4$ are on simultaneously. Preferably, the controller 32, by way of the JFETs 30*a* and 30*b*, pulses the source voltage $V_s$, provided to the substrate heater resistors 26. By controlling the width of the pulses, the controller 32 controls the temperature of the chip 16.

It is contemplated, and will be apparent to those skilled in the art from the preceding description and the accompanying drawings that modifications and/or changes may be made in the embodiments of the invention. For example, since it is the ratio of resistor length to width that determines the resistance value of a thin-film resistor, the difference in resistance values of the first, second, third, and fourth substrate heater resistors could be accomplished by differing the lengths of the resistors while keeping their widths equal. Further, the difference in resistance values could be accomplished by differing the thickness of the Tantalum Aluminum material that makes up the resistors instead of by differing their widths. Accordingly, it is expressly intended that the foregoing description and the accompanying drawings are illustrative of preferred embodiments only, not limiting thereto, and that the true spirit and scope of the present invention be determined by reference to the appended claims.

What is claimed is:

1. An ink jet print head used in an ink jet printing apparatus, the print head comprising:

a nozzle plate having a substantially linear array of ink jet nozzles through which ink droplets are ejected toward a print medium; and an integrated circuit chip disposed adjacent the nozzle plate, the chip having a length and a width, comprising:

a semiconductor substrate;

a source voltage conductor disposed on the substrate and connected to a source voltage;

a ground return conductor disposed on the substrate;

a plurality of ink heating resistors disposed on the semiconductor substrate in a substantially linear arrangement which is substantially parallel to the length of the chip, each of the ink heating resistors being associated with a corresponding one of the ink jet nozzles; and a plurality of substrate heater resistors distributed across the semiconductor substrate in a substantially linear arrangement of three or more substrate heater resistors which is substantially parallel with the ink heating resistors, the substrate heater resistors being electrically connected in parallel, with one node of each of the substrate heater resistors being connected to the source voltage conductor and another node of each of the substrate heater resistors being connected to the ground return conductor.

2. The ink jet print head of claim 1 wherein the plurality of substrate heater resistors further comprises:

first substrate heater resistors having first electrical resistance values and being disposed near a lengthwise center of the chip, the first electrical resistance values being determined by thermal dissipation patterns of the chip; and second substrate heater resistors having second electrical resistance values and being distally disposed relative to the lengthwise center of the chip, the second electrical resistance values being determined by thermal dissipation patterns of the chip and being different from the first electrical resistance values, wherein the difference between the first and second electrical resistance values cause the first and second substrate heater resistors to generate different amounts of heat when supplied with the source voltage, the different amounts of heat generated by the first and second substrate heater resistors and the relative positions of the first and second substrate heater resistors compensating for differing thermal dissipation patterns across the chip.

3. The ink jet print head of claim 2 wherein the plurality of substrate heater resistors further comprise third substrate heater resistors having third electrical resistance values and being disposed on the chip between the first and second substrate heater resistors, the third electrical resistance values being determined by thermal dissipation patterns of the chip and being different from the first and second electrical resistance values, wherein the difference between the first, second, and third electrical resistance values cause the first, second, and third substrate heater resistors to generate different amounts of heat when supplied with the source voltage, the different amounts of heat generated by the first, second, and third substrate heater resistors and the relative positions of the first, second, and third substrate heater resistors compensating for differing thermal dissipation patterns across the chip.

4. The ink jet print head of claim 3 wherein the plurality of substrate heater resistors further comprise fourth substrate heater resistors having fourth electrical resistance values and being disposed on the chip between the second and third substrate heater resistors, the fourth electrical resistance values being determined by thermal dissipation patterns of the chip and being different from the first a second, and third electrical resistance values, wherein the difference between the first, second, third, and fourth electrical resistance values cause the first, second, third, and fourth substrate heater resistors to generate different amounts of heat when supplied with the source voltage, the different amounts of heat generated by the first, second, third, and fourth substrate heater resistors and the relative positions of the first, second, third, and fourth substrate heater resistors compensating for differing thermal dissipation patterns across the chip.

5. The ink jet print head of claim 1 wherein the chip further comprises:

input/output connection pads for making electrical connection with electrical components on the chip, the pads disposed on the substrate toward an extremity of the width of the chip and aligned substantially parallel with the length of the chip; and the plurality of substrate heater resistors being disposed on the substrate between the input/output connection pads and the ink heating resistors.

6. The ink jet print head of claim 1 wherein:

the linear array of ink jet nozzles further comprises two substantially parallel columns of nozzles that are substantially aligned with the length of the chip;

the plurality of ink heating resistors further comprises two substantially parallel columns of resistors that are substantially aligned with the length of the chip; and the plurality of substrate heater resistors further comprises two substantially parallel columns of substrate heater resistors that are substantially aligned with the length of the chip, with one column of substrate heater resistors disposed to either side of the two columns of ink heating resistors.

7. An ink jet print head used in an ink jet printing apparatus, the print head comprising:

a nozzle plate having a substantially linear array of ink jet nozzles through which ink droplets are ejected toward a print medium; and an integrated circuit chip disposed adjacent the nozzle plate, the chip having a length and a width, comprising:

a semiconductor substrate;

a source voltage conductor disposed on the substrate and connected to a driving voltage;

a ground return conductor disposed on the substrate;

a plurality of ink heating resistors disposed on the semiconductor substrate in a substantially linear arrangement, each of the ink heating resistors being associated with a corresponding one of the ink jet nozzles; and a plurality of substrate heater resistors distributed across the semiconductor substrate in a substantially linear arrangement which is substantially parallel with the ink heating resistors, substrate heater resistors comprising:

first substrate heater resistors having first electrical resistance values and being disposed near a lengthwise center of the chip, the first electrical resistance values being determined by thermal dissipation patterns of the chip; and second substrate heater resistors having second electrical resistance values and being distally disposed relative to the lengthwise center of the chip, the second electrical resistance values being determined by thermal dissipation patterns of the chip and being different from the first electrical resistance values, wherein the difference between the first and second electrical resistance values cause the first and second substrate heater resistors to generate different amounts of heat when supplied with the source voltage, the different amounts of heat generated by the first and second substrate heater resistors and the relative positions of the first and second substrate heater resistors compensating for differing thermal dissipation patterns across the chip.

8. The ink jet print head of claim 7 wherein the plurality of substrate heater resistors further comprise third substrate heater resistors having third electrical resistance values and being disposed on the chip between the first and second Substrate heater resistors, the third electrical resistance values being determined by thermal dissipation patterns of the chip and being different from the first and second electrical resistance values, wherein the difference between the first, second, and third electrical resistance values cause the first, second, and third substrate heater resistors to generate different amounts of heat when supplied with the source voltage, the different amounts of heat generated by the first, second, and third substrate heater resistors and the relative positions of the first, second, and third substrate heater, resistors compensating for differing thermal dissipation patterns across the chip.

9.The ink jet print head of claim 8 wherein the plurality of substrate heater resistors further comprise fourth substrate heater resistors having fourth electrical resistance values and being disposed on the chip between the second and third substrate heater resistors, the fourth electrical resistance values being, determined by thermal dissipation patterns of the chip and being different from the first, second, and third electrical resistance value, wherein the difference between the first, second, third, and fourth electrical resistance values cause the first, second, third, and fourth substrate heater resistors to generate different amounts of heat when supplied with the source voltage, the different amounts of heat generated by the first, second, third, and fourth substrate heater resistors and the relative positions of the first, second, third, and fourth substrate heater resistors compensating for differing thermal dissipation patterns across the chip.

10. The ink jet print head of claim 7 wherein the chip further comprises:

input/output connection pads for making electrical connection with electrical components on the chip, the pads disposed on the substrate toward an extremity of the width of the chip and aligned substantially parallel with the length of the chip; and the plurality of substrate heater resistors being disposed on the substrate between the input/output connection pads and the ink heating resistors.

11. The inkjet print head of claim 7 wherein:

the linear array of ink jet nozzles further comprises two substantially parallel columns of nozzles that are substantially aligned with the length of the chip;

the plurality of ink heating resistors further comprises two substantially parallel columns of resistors that are substantially aligned with the length of the chip; and the plurality of substrate heater resistors further comprises two substantially parallel columns of substrate heater resistors that are substantially aligned with the length of the chip, with one column of substrate heater resistors disposed to either side of the two columns of ink heating resistors.

12. An ink jet print head used in an ink jet printing apparatus, the print head comprising:

a nozzle plate having a substantially linear array of ink jet nozzles through which ink droplets are ejected toward a print medium; and an integrated circuit chip disposed adjacent the nozzle plate, the chip having a length and a width, comprising:

a semiconductor substrate;

a source voltage conductor disposed on the substrate and connected to a source voltage;

a ground return conductor disposed on the substrate;

ink heating resistors disposed on the semiconductor substrate in a substantially linear arrangement, each of the ink heating resistors being associated with a corresponding one of the ink jet nozzles;

input/output connection pads for making electrical connection with electrical components on the chip, the pads disposed on the substrate toward an extremity of the width of the chip and aligned substantially parallel with the length of the chip; and a plurality of substrate heater resistors distributed across the semiconductor substrate in a substantially linear arrangement between and substantially parallel with the input/output connection pads and the array of ink heating resistors, the substrate heater resistors being electrically connected in parallel, with one node of each of the substrate heater resistors being connected to the source voltage conductor and another node of each of the substrate heater resistors being connected to the ground return conductor, the substrate heater resistors further comprising:

first substrate heater resistors having first electrical resistance values and being disposed near a lengthwise center of the chip, the first electrical resistance values being determined by thermal dissipation patterns of the chip;

second substrate heater resistors having second electrical resistance values and being distally disposed relative to the lengthwise center of the chip, the second electrical resistance values being determined by thermal dissipation patterns of the chip and being different from the first electrical resistance values;

third substrate heater resistors having third electrical resistance values and being disposed on the chip between the first and second substrate heater resistors, the third electrical resistance values being determined by thermal dissipation patterns of the chip and being different from the first and second electrical resistance values; and fourth substrate heater resistors having fourth electrical resistance values and being disposed on the chip between the second and third substrate heater resistors, the fourth electrical resistance values being determined by thermal dissipation patterns of the chip and being different from the first, second, and third electrical resistance values, wherein the difference between the first, second, third, and fourth electrical resistance values cause the first, second, third, and fourth substrate heater resistors to generate different amounts of heat when supplied with the source voltage, the different amounts of heat generated by the first, second, third, and fourth substrate heater resistors and the relative positions of the first, second, third, and fourth substrate heater resistors compensating for differing thermal dissipation patterns across the chip.

* * * * *